US008033538B2

(12) United States Patent
Wicki et al.

(10) Patent No.: US 8,033,538 B2
(45) Date of Patent: Oct. 11, 2011

(54) METHOD AND APPARATUS FOR PRODUCING PRINTED PRODUCTS INCLUDING WIRE-STITCHED BOOKLETS HAVING RESHAPED SPINES

(75) Inventors: Herbert Wicki, Ruswil (CH); Christoph Gysin, Ormalingen (CH); Roland Kost, Oftringen (CH); Roger Schwenter, Trimbach (CH)

(73) Assignee: Mueller Martini Holding AG, Hergiswil (CH)

( * ) Notice: Subject to any disclaimer, the term of this patent is extended or adjusted under 35 U.S.C. 154(b) by 27 days.

(21) Appl. No.: 12/565,162

(22) Filed: Sep. 23, 2009

(65) Prior Publication Data

US 2010/0074713 A1 Mar. 25, 2010

(30) Foreign Application Priority Data

Sep. 23, 2008 (EP) ..... 08405235

(51) Int. Cl.
*B42C 5/02* (2006.01)

(52) U.S. Cl. ..... 270/52.18; 270/52.26; 270/52.29

(58) Field of Classification Search ..... 270/52.18, 270/52.26, 52.29
See application file for complete search history.

(56) References Cited

U.S. PATENT DOCUMENTS

| | | | | |
|---|---|---|---|---|
| 2,066,620 | A * | 1/1937 | Grammer | 281/27.3 |
| 2,068,603 | A * | 1/1937 | Grammer | 281/21.1 |
| 4,556,353 | A * | 12/1985 | Ehlermann | 412/5 |
| 5,678,813 | A * | 10/1997 | Osako et al. | 270/52.16 |
| 6,328,519 | B1 * | 12/2001 | Nagai | 412/8 |
| 6,612,559 | B2 * | 9/2003 | Boss | 270/52.18 |
| 7,384,030 | B2 * | 6/2008 | Nagai | 270/52.18 |
| 2004/0239026 | A1 * | 12/2004 | Nagai | 270/58.08 |

FOREIGN PATENT DOCUMENTS

| | | |
|---|---|---|
| DE | 2158542 | 5/1972 |
| EP | 1118475 A1 | 7/2001 |
| EP | 1479528 A2 | 11/2004 |
| EP | 1690696 A1 | 8/2006 |
| EP | 1821510 A2 | 8/2007 |
| FR | 2119947 | 8/1972 |
| GB | 1121493 | 7/1968 |

OTHER PUBLICATIONS

European Search Report from EP Application No. 08405235.6.

* cited by examiner

*Primary Examiner* — Patrick Mackey
(74) *Attorney, Agent, or Firm* — Venable LLP; Robert Kinberg; Ryan M. Flandro

(57) ABSTRACT

A method for producing a printed product that includes supplying a wire-stitched booklet to a spine processing device such that the booklet includes signatures and a spine. The method includes reshaping the spine in the spine processing device. Following the reshaping, the method further includes supplying a cover to the booklet, applying adhesive to the cover or to the reshaped spine, and combining the cover with the booklet to form the printed product. The method includes discharging the printed product from the spine processing device.

23 Claims, 4 Drawing Sheets

METHOD AND APPARATUS FOR PRODUCING PRINTED PRODUCTS INCLUDING WIRE-STITCHED BOOKLETS HAVING RESHAPED SPINES

CROSS-REFERENCE TO RELATED APPLICATION

This application claims the priority of the European Patent Application No. 08405235.6, filed on Sep. 23, 2008, the subject matter of which is incorporated herein by reference.

FIELD

The following paragraphs relate to a method and an apparatus for producing printed products, for which individual stitched booklets comprising a plurality of signatures or a signature and respectively provided with a spine, are supplied to a spine processing device in which the spines of these booklets are reshaped.

U.S. Pat. No. 5,678,813 discloses a method for producing stitched printed products. With this method, a booklet stitched from the inside toward the outside is attached with adhesive to a second booklet stitched from the outside toward the inside. This type of production positions the legs of the wire staples on the inside and the wire staples are covered by the second booklet. However, this method does not reshape the spine of the printed product and consequently, there are no flat end surfaces for writing on or printing on available on the printed product. In addition, printed products that are produced with this method lack a high-quality appearance because the wire staples are visible on the spine. Finally, the method is also relatively involved.

European patent document EP-A-1 479 528 describes a device for gathering, stitching and squeezing of the signatures. The device comprises squeezing jaws on the side of the printed product and includes a press-on roller that rolls along the end face of the printed product for reshaping the product spine. The reshaping can be used to produce a spine having a square shape, which offers an additional area for writing on or printing on. For example, a title, a subject, an author, a volume number, and the like could be printed on the additional area. Printed products of this type can be placed onto a book shelf and can be easily identified by the inscription on the spine. They can furthermore be opened up all the way to the spine, so that they do not close up by themselves. To be sure, the appearance of these printed products is of a higher quality than that of products stitched with the standard method, but the production is considerably more involved and thus also more expensive. The products must furthermore be stopped for the reshaping of the spine which hinders high production capacities.

European patent document EP-A-1 590 696 discloses a method and an apparatus for squeezing stitched printed products that have been collected on a gathering and wire-stitching machine and encased by a cover. Squeezing eliminates the excessive product thickness in the spine region of the printed products, caused by the folding, thus increasing the processing safety for the following method steps. The squeezing of the spine occurs inside the gathering and wire-stitching machine in a spine processing device arranged downstream of the stitching station. However, this method does not provide a flat surface on the spine, which could be used for an inscription. The printed products produced with this method furthermore do not have a high quality appearance since the staples are also visible along the spine.

SUMMARY

According to an embodiment, there is provided a method for producing a printed product, comprising: supplying a wire-stitched booklet to a spine processing device, wherein the booklet comprises a plurality of signatures and a spine; reshaping the spine in the spine processing device; following the reshaping: supplying a cover to the booklet; applying adhesive to the cover or to the reshaped spine; combining the cover with the booklet to form the printed product; and discharging the printed product from the spine processing device.

According to an embodiment, there is provided an apparatus for producing printed products comprising wire-stitched booklets that include a plurality of signatures and a spine, the apparatus comprising: a spine processing device to reshape the spine of the booklet, wherein the spine processing device comprises a reshaping device, an adhesive application device, and a device to attach the cover to the booklet.

According to an embodiment, there is provided a method in that following the reshaping of the spine, respectively a cover is supplied to a booklet, that adhesive is applied either to the cover or to the reshaped spine, that the cover and the respective booklet are then combined to form a printed product, and that the printed product is subsequently transported out of the spine processing device. The spine processing device is provided for this with a reshaping device, an adhesive-application station as well as a device to attach a cover to the booklet. The method and the associated apparatus make it possible to produce at comparably low production costs stitched printed products with an appearance similar to high-quality, adhesive-bound books, which can be provided with an inscription on the back and which do not show staples along the spine.

According to one embodiment, the reshaping, the applying of adhesive, as well as the combining of the cover and the booklet, which are realized in the spine processing device, are carried out independent of the upstream or downstream occurring processing steps for producing the printed products since the spine processing device is embodied as an independent module. The spine processing device may therefore be used separately as well as in combination with various other devices for producing printed products.

In another embodiment, the signatures are deposited with the aid of a plurality of feeders onto a conveying and stitching line of a saddle stitcher before a booklet is supplied to a spine processing device, are collected thereon, and are then stitched with a stitching machine to form a booklet. Once the printed product formed in the spine processing device is discharged from the spine processing device, it is supplied to a trimmer and is trimmed therein. The spine processing device therefore may form a component of a saddle stitcher and may be arranged between its stitching and trimming components. The printed product is trimmed in the trimmer, independent of whether or not the product spine was reshaped. While the method permits the use of a standard saddle stitcher, the apparatus makes it possible to retrofit a known saddle stitcher of this type. It may therefore not be necessary in either case to make essential changes to the saddle stitcher. Since the spine processing steps may be realized outside of the saddle stitcher, inside a separate module, the method furthermore provides a higher operational safety.

According to a different embodiment, the processing carried out in the spine processing device is added optionally, meaning the spine processing device is designed such that it may be connected to or disconnected from the saddle stitcher. Since the reshaping of the spine as well as the attaching of the cover may be carried out or omitted, depending on the requirements, this method and the corresponding device advantageously provide a higher flexibility for the production of printed products. The saddle stitcher may therefore be used to produce the standard, stitched booklets or alternatively also the high-quality stitched printed products.

According to one modification, the processing in the spine processing device may either be added or suppressed precisely with the product at the production speed of the saddle stitcher. A precise cooperation between the saddle stitcher and the spine processing device may thus be ensured along with a corresponding quality for the printed product.

According to yet another modification, the operating steps in the separate spine processing device are realized while the product is passing through, meaning the spine-reshaping, the adhesive application, and the attaching of the cover are carried out continuously. As a result, the products do not need to be stopped and restarted during the processing, which results in a considerably higher high production capacity and also a careful transport.

One modification provides that the spine processing device is connected via a diverter to a transport section of the saddle stitcher, so that the stitched booklet is supplied via this diverter to the spine processing device. The diverter may alternatively allow circumventing the spine processing device in the manner of a bypass. The stitched booklet can thus be conveyed with the aid of the diverter either to the spine processing device where it can be reshaped, provided with adhesive and a cover, or it can be conveyed further without these processing steps, for example directly to a trimmer. The production system consequently has a higher flexibility. Regardless of whether or not the processing steps of reshaping, applying the adhesive and attaching a cover have been carried out, the conveying direction, as well as the position and the orientation of the printed product is the same at the outlet for the spine processing device.

According to one modification, before the booklet is reshaped, it is placed in an upright position and aligned on the side while located in a section intended for changing the direction and positioning upright. According to yet another modification, it is furthermore provided that the booklet spine may essentially be reshaped to be square or rectangular. The cover is then attached with adhesive to the square spine and is pressed on. The resulting printed product may also have a square or rectangular back, which can be imprinted or inscribed before the cover is supplied to the associated booklet or is available for a later inscription. With the aid of the delivery station, the processed printed product may be returned to the original product position and conveying direction and may be again inserted into the conveying section of the saddle stitcher.

According to another modification, differently composed booklets are successively supplied to the spine processing device, which correspondingly processes the booklets into different products and subsequently transports them out of the spine processing device. The combination of saddle stitcher and spine processing device may thus be used with extreme flexibility and may furthermore be used for the additional processing steps following a digital printer.

According to another modification, there is provided a saddle stitcher with a spine processing device.

Additional advantageous features follow from the dependent claims, the following description, as well as the drawings.

BRIEF DESCRIPTION OF THE DRAWINGS

The subject matter of the application will be more readily understood from the following detailed description when read in conjunction with the accompanying drawings, in which.

DETAILED DESCRIPTION

Figure 1:
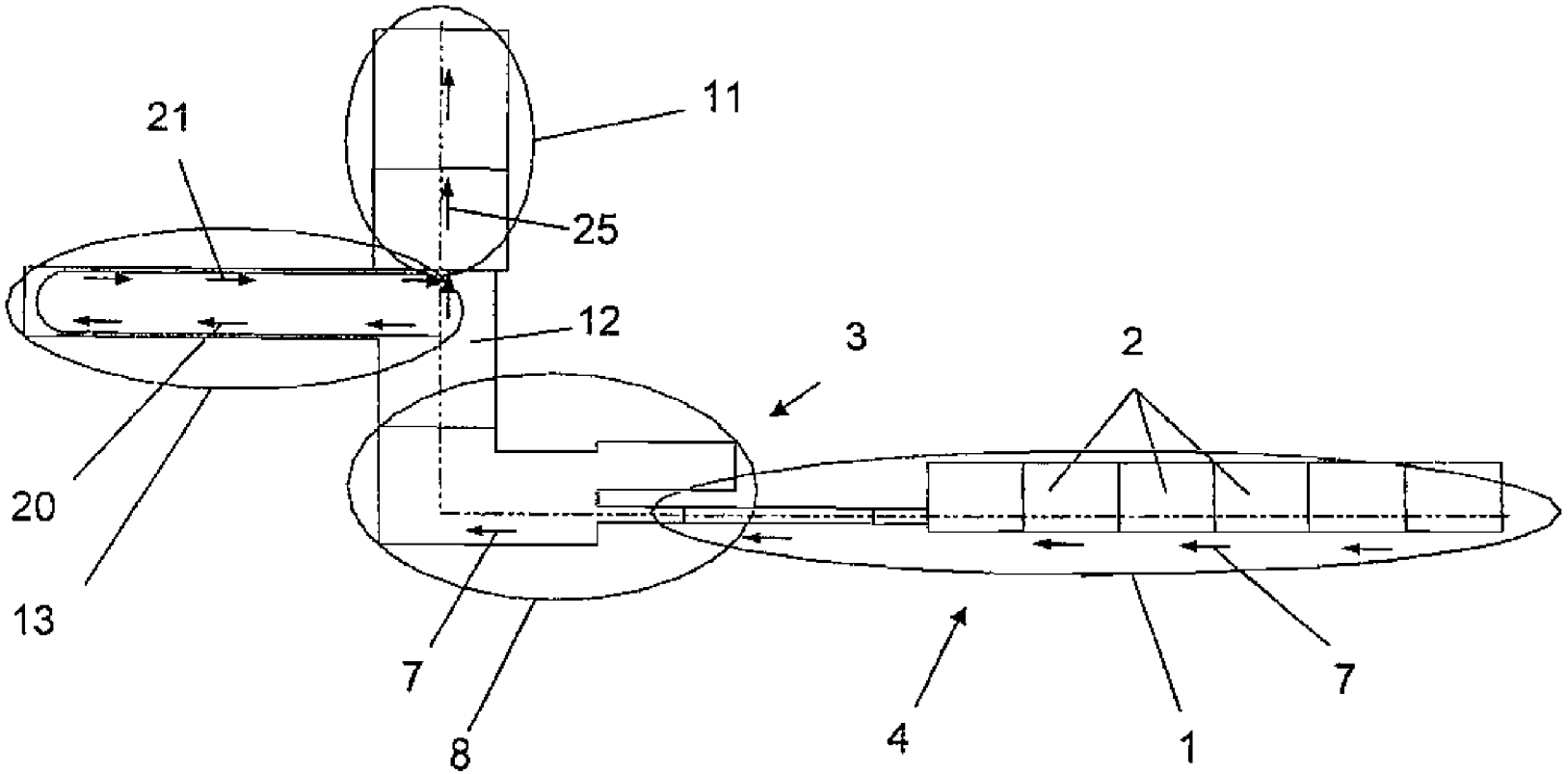
FIG. 1 is a schematic view of a saddle stitcher provided with a spine processing device.
Figure 3:
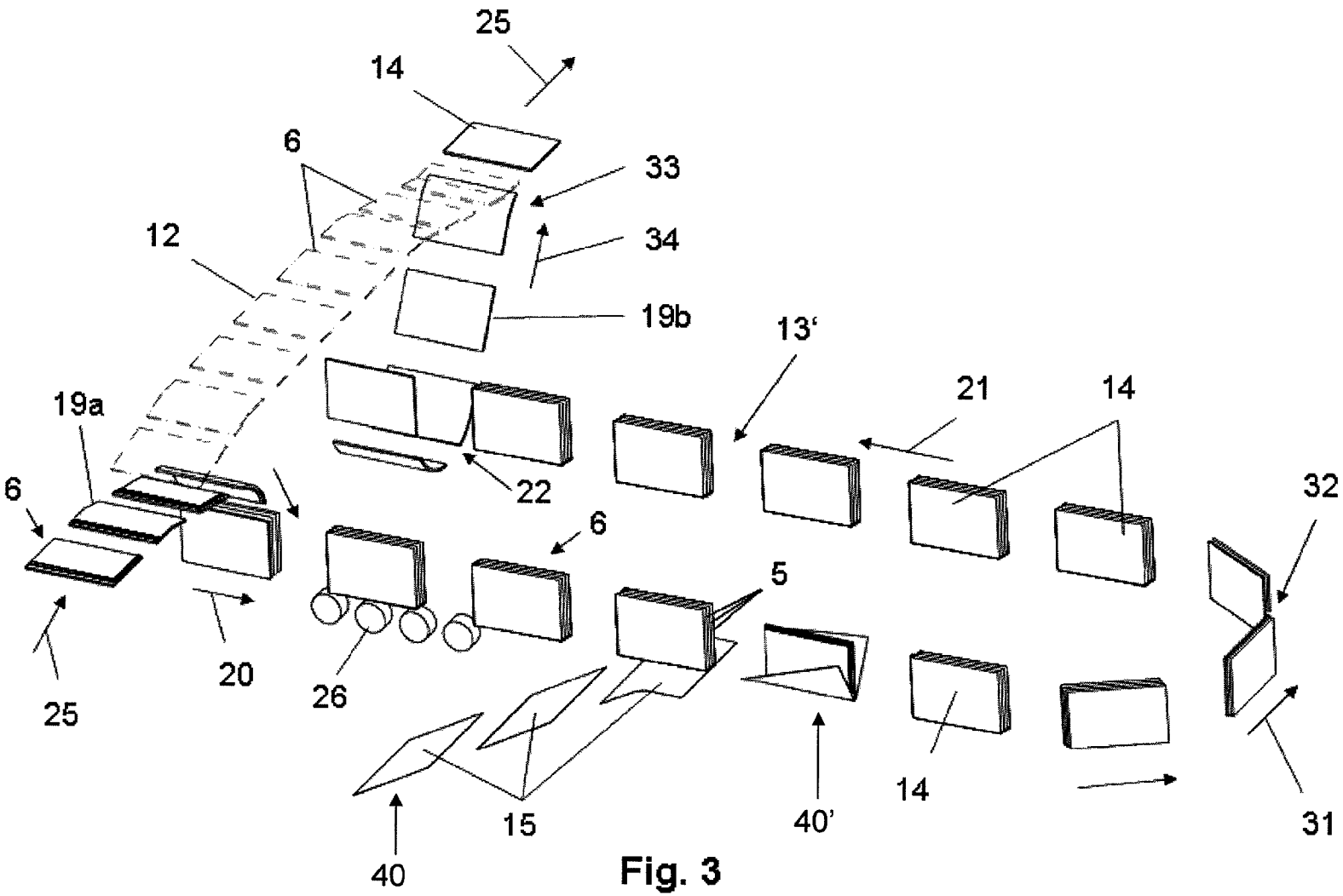
FIG. 3 is a schematic view of a second variant of the spine processing device.

FIG. 1 shows a gathering section 1, provided in a manner known per se with several feeders 2, arranged along a conveying and stitching line 3 of a saddle stitcher 4, which can be used to withdraw respectively one signature 5 (FIG. 4) from a stack, not shown herein, and deposit the signature 5 onto the conveying and stitching line 3. The signatures 5 or folded sheets can thus be collected to form a booklet 6 (FIG. 3).

Figure 4:
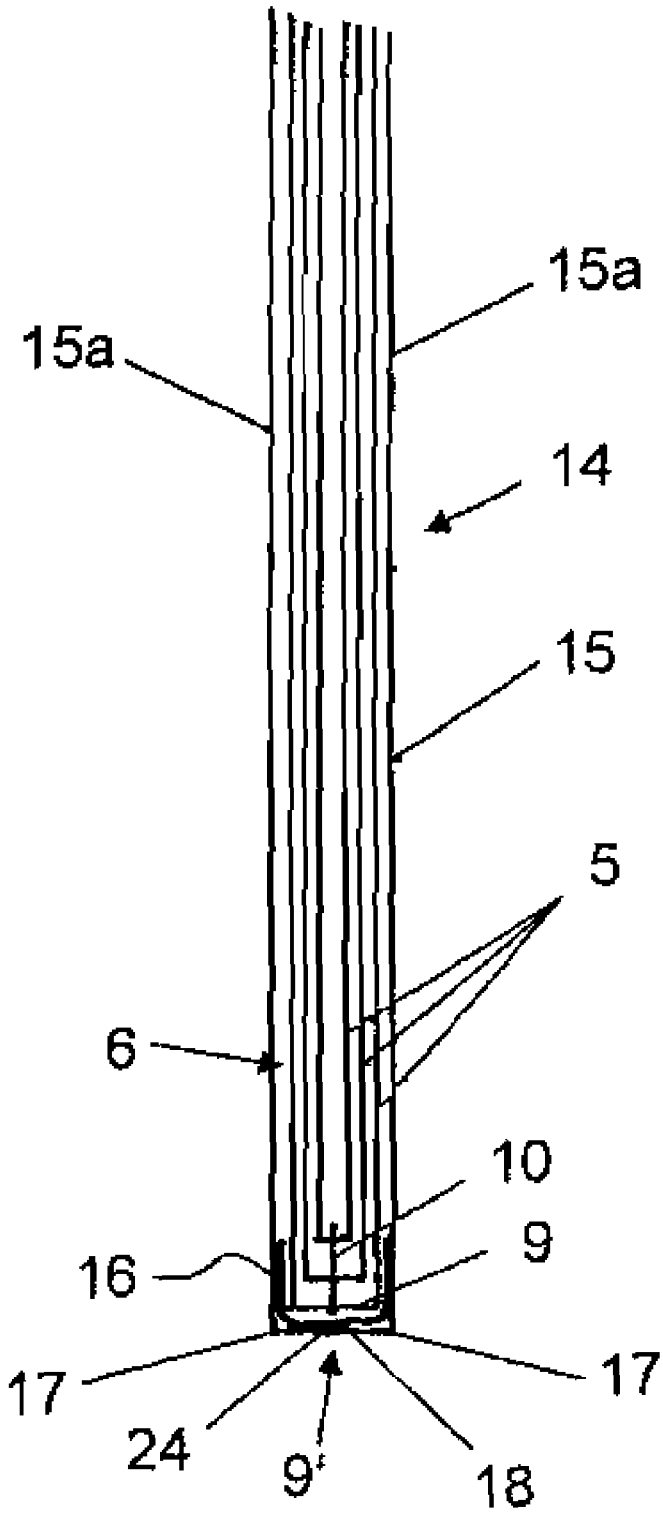
FIG. 4 is a sectional view through a printed product that is produced with the method.

The arrows in FIG. 1 indicate that the direction of transport 7 is from the right to the left. In a stitching machine 8 that is known per se, the booklets 6 may be conveyed further in transporting direction 7 and may be respectively provided on the spine 9 with at least one staple 10 (FIG. 4). Arranged downstream of the stitching machine 8 is a trimmer 11, which may have a standard design and can be a three-way trimmer. A trimmer 11 of this type may be used to trim the top, the bottom and one side.

A transport section 12 of the saddle stitcher 4, which follows the transport and stitching line 3, may be arranged between the stitching machine 8 and the trimmer 11. Starting with this transport section 12, a spine processing device 13 may be connected into the paper processing operation of the saddle stitcher 4, in which a booklet 6 that may be wire-stitched in the stitching machine 8 may be processed further into a printed product 14, as shown in FIG. 4.

The printed product 14 may be held together with a plurality of wire staples 10 and may comprise signatures 5 that are essentially reshaped to have a square or rectangular form. A cover 15 may be attached to the outside of the outermost signature 5 for the booklet 6 by applying a layer of adhesive 16 either to the outermost signature 5 or to the cover 15, to attach the cover 15 along at least one section and advantageously along the total length of the spine 9 to the booklet 6. The adhesive layer, shown as U-shaped coat of adhesive along the sides and the spine, may conceivably also be applied only to the spine or only to the sides.

By attaching the cover 15 to the square-shaped spinal area of the booklet 6, the back 9' of the printed product 14 is also given a square shape, as shown in FIG. 4, with two parallel edges 17 that extend at a distance to each other. The back 9' therefore has an outer end face 18, for example having a width of 13 mm, which may be imprinted or inscribed. The end face may be imprinted or inscribed either during the production of the cover 15 already or immediately thereafter. Alternatively, the back 9' of the printed product 14 may be imprinted or inscribed before the cover 15 is supplied to the associated booklet 6 (e.g., as indicated at arrow 40 in FIG. 3) or only after the cover 15 and the booklet 6 have been joined (e.g., as indicated at arrow 40' in FIG. 3). As a result, the printed product 14 can thus be placed onto a book shelf and identified by the information provided on the back 9' in a similar manner as a book.

Figure 2:
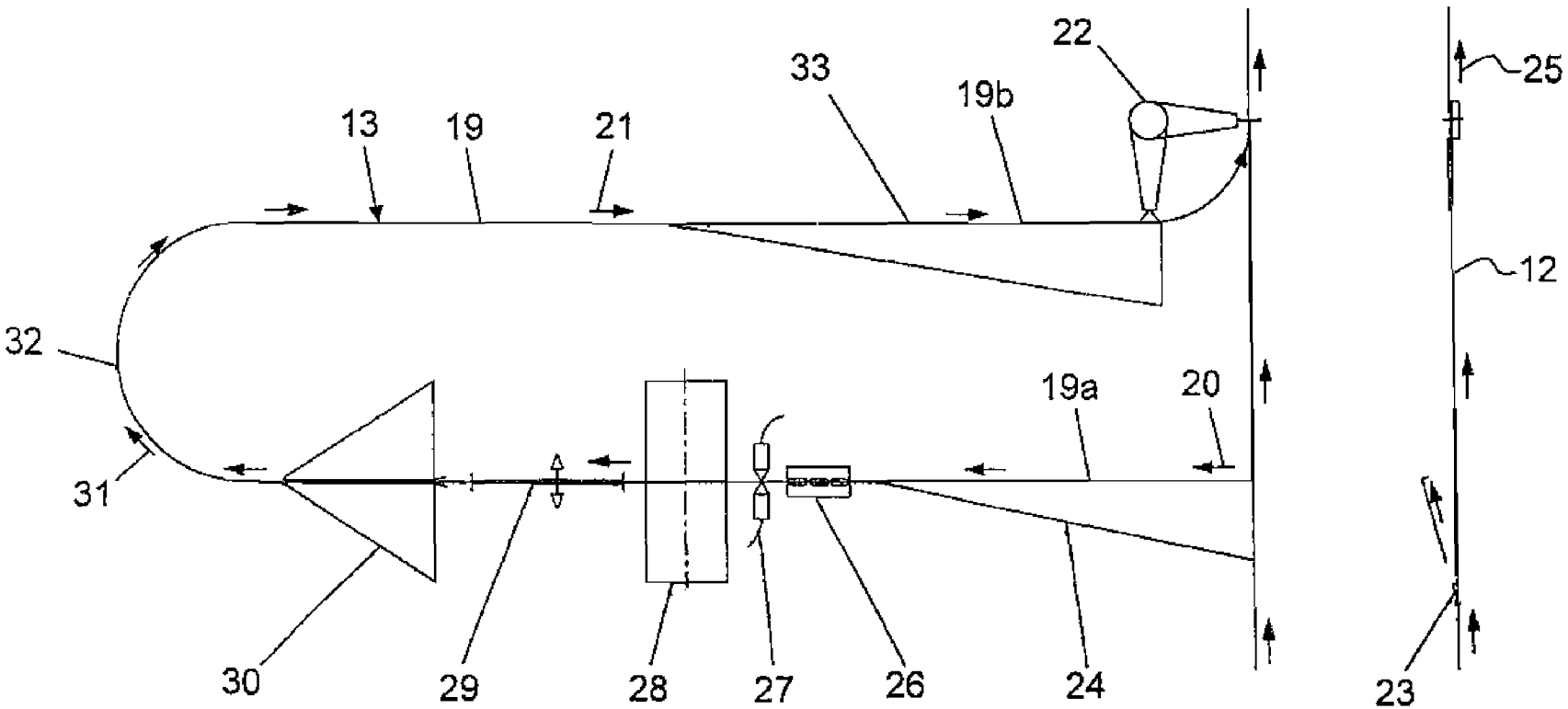
FIG. 2 is a schematic view of a spine processing device that is connected to a conveying and wire-stitching line of the saddle stitcher.

The spine processing device 13 according to FIG. 2 may be provided with a U-shaped or loop-shaped transporting device 19, having an intake region 19*a* and a discharge region 19*b*, on which a stitched booklet 6 may be initially conveyed away from the transporting section 12 in a first transporting direction 20. The booklet 6 may then be processed further into a printed product 14 and may finally be returned with the aid of a delivery station 22 to the transporting section 12 as a printed product 14 moving in a second transporting direction 21. Of course, the transporting device 19 may also have a different, suitable form. The corresponding operating steps for the further processing may be realized while the product is passing through, so that the booklet 6 to be processed does not need to be stopped or accelerated again in the spine processing device 13. The components of the spine processing device 13, described in further detail in the following paragraphs, may be arranged one behind the other in a row for this processing.

The transport section 12 of the saddle stitcher 4 may be connected via a diverter 23 to the intake area 19*a* of the transport device 19. Depending on the type of planned further processing, the diverter 23 may be adjusted such that a stitched booklet 6 may be supplied either to the spine processing device 13 or directly to the trimmer 11, via the transport section 12 that may be used as a bypass. The reversal of the diverter 23 takes place, for example, while the saddle stitcher 4 is standing still, in the form of a change in the operating mode. However, the diverter 23 may conceivably also be reversed at full production speed, by coordinating it with the machine cycle.

A section 24 for changing direction and placing the booklet in the upright position follows the intake area 19*a* of the transporting device 19, in which the booklet 6 that is removed via the diverter 23 from the transport section 12 may be positioned upright with the spine 9 being on the bottom. The transporting direction of the booklet 6 may also be changed essentially at the same time, for example by approximately 90°. Following the reversal in direction and the upright positioning step 24, the booklet 6 that is previously transported on the transport section 12 in a transporting direction 25, is thus essentially conveyed in transporting direction 20 of the transport device 19. The booklet 6 is subsequently supplied to a device 26 for reshaping the spine into a square or rectangular shape, as shown in FIG. 4. Reshaping devices 26 of this type are known per se and comprise, for example, rollers which are not shown herein between which the booklet 6 is moved through. To ensure a continuous further processing of the booklets 6, these rollers can be arranged successively at continuously shorter distances to each other.

The reshaping device 26 is followed by an adhesive application station 27 provided with a roller or a nozzle for applying adhesive 16 to the square-shaped spine 9 of the booklet 6. In the process, the adhesive 16 may be applied to the flat end face 18 of the outer signature 5, created during the reshaping 26, as well as optionally also to a short section of the two side surfaces. Adhesive application stations of this type are known to one skilled in the art, wherein the adhesive may be applied with a roller or a nozzle. As an alternative to applying adhesive to the booklet 6, the adhesive may also be applied to the inside of the cover 15 just prior to combining it with the booklet 6.

Arranged downstream of the adhesive application station 27 is a press-on drum 28 for rolling or pressing a cover 15 onto the reshaped spine 9 of the booklet 6, wherein the cover 15 is supplied by a cover feeder, not shown herein, to the transport device 19. The cover 15 may be scored ahead of time to achieve a defined bending location along the edges 17. The spacing between the two scored lines depends on the thickness of the booklet 6.

The press-on drum 28 may be followed by a pressing device 29, provided with press-on rollers or bands, for folding the rolled-on cover 15 over the spine 9 of the booklet 6. In addition, the contact surfaces of the booklet 6 and the cover is are pressed together, thus achieving a suitable wetting with the adhesive 16 of the paper surfaces to be joined, In a following unfolding station 30, the legs 15*a* of the cover 15 are folded up on both sides and into the position shown in FIG. 4. It is conceivable that the sequence for arranging the unfolding station 30 and the pressing device 29 may be reversed.

The movement direction of the printed products 14, comprising the booklets 6 respectively provided with the cover 15, may be subsequently reversed by about 180° in a reversing section 32 that moves in a transport direction 31. The booklets may continue to be positioned with the back 9' on the bottom. The reversing section 32 essentially functions to again reverse the direction for the printed products 14 such that they move in the direction of the transport section 12. The precise position of the reversing section 32 within the processing operation is not fixed to the above-described arrangement. For example, it may also be arranged between the reshaping device 26 and the adhesive application station 27.

The discharge region 19*b* of the transport device 19 may have a section 33 in which the printed products 14 with the end faces 18 are placed into a horizontal position. Following this, the movement direction of the horizontally positioned printed products 14 is changed by 90° with the aid of the delivery station 22, arranged in the discharge region 19*b*, so that the printed products may be transferred to the transport section 12. The printed products 14 may be transported by the delivery station 22 so that the backs 9' are oriented substantially perpendicular to the transporting direction 25 of the transport section 12 during the transport. Suitable delivery stations 22 are known to one skilled in the art.

Finally, the printed products 14 may be supplied to the trimmer 11 and are trimmed therein on at least one side, but advantageously on the top, the bottom and the front.

The spine processing device 13' shown in FIG. 3 has essentially the same design as the above-mentioned spine processing device 13, but is arranged to the right of the transport section 12 in transporting direction 25. As can be seen, a stitched booklet 6 can optionally be transported over the bridge-type transport section 12 to a trimmer 11, not shown herein, where it may be trimmed, or it may be processed in the spine processing device 13' as explained in the above. The booklet 6 may be transported while positioned horizontal until it reaches the intake region 19*a*.

During the processing in the spine processing device 13', the booklet 6 may be moved to the upright position with the stitched back 9 on the bottom and the booklet 6 may be conveyed in a transporting direction 20, meaning essentially at a right angle to the transporting direction 25 of the transport section 12. The following processing devices and processing steps correspond to those of the spine processing device 13. The transporting direction 31, shown with arrow, indicates the change in direction by approximately 180° in the reversing section 32, so that the booklet 6 provided with the cover 15 is again transported in the form of the printed product 14 in the direction of the transport section 12.

In the following discharge region 19*b*, the vertically oriented printed products 14 are redirected by 90° with the aid of the delivery station 22, wherein following the change in direction the printed products are transported while still positioned upright. Arranged downstream of the delivery station 22 in the transporting direction 34, indicated by an arrow, is the laying-down section 33 in which the printed products 14 may be changed to the horizontal position and may be then conveyed to the transport section 12. In this section, the printed products 14 may be conveyed further in the transporting direction 25, for example to the trimmer 11.

It will be understood that the above description of the present apparatus and method are susceptible to various modifications, changes and adaptations, and the same are intended to be comprehended within the meaning and range of equivalents of the appended claims.

What is claimed is:

1. A method for producing a printed product, comprising:

wire-stitching signatures with a saddle stitcher to form a wire-stitched booklet comprising a plurality of the signatures and a spine, the saddle stitcher including a transport section;

diverting the wire-stitched booklet by a diverter of the transport section and supplying the diverted wire-stitched booklet to a spine processing device;

reshaping the spine in the spine processing device;

following the reshaping:

supplying a cover to the booklet;

applying adhesive to the cover or to the reshaped spine; and combining the cover with the booklet to form the printed product; and discharging the printed product from the spine processing device.

2. The method according to claim 1, wherein the reshaping the spine, supplying a cover, applying adhesive, and combining the cover to the booklet occur in the spine processing device, independent of preceding or following operational steps for producing the printed product.

3. The method according to claim 1, wherein prior to the diverting of the booklet to the spine processing device, the method further comprises:

depositing and collecting the signatures with aid of a plurality of feeders onto a transport and stitching line of the saddle stitcher;

and wherein following the discharging, the method further comprises:

supplying the printed product to a trimmer for trimming.

4. The method according to claim 3, comprising adding operational steps occurring in the spine processing device to operational steps of the saddle stitcher.

5. The method according to claim 4, comprising one of adding the operational steps occurring in the spine processing device precisely synchronized with a speed of the printed product in the saddle stitcher or suppressing the operational steps.

6. The method according to claim 1, wherein the reshaping, supplying, applying, and combining in the spine processing device occur while the printed product is passing through the spine processing device.

7. The method according to claim 1, further comprising prior to the reshaping, positioning the booklet substantially upright so that the booklet rests on the spine.

8. The method according to claim 1, wherein the reshaping includes reshaping the spine into a substantially rectangular spine and wherein the combining forms the printed product with a substantially rectangular back.

9. A method for producing a printed product, comprising:

supplying a wire-stitched booklet to a spine processing device, wherein the booklet comprises a plurality of signatures and a spine;

reshaping the spine in the spine processing device into a substantially rectangular spine;

following the reshaping:

supplying a cover to the booklet;

applying adhesive to the cover or to the reshaped spine, combining the cover with the booklet to form the printed product with a substantially rectangular back, wherein one of (a) prior to supplying the cover to the booklet, imprinting or inscribing on an area of the cover that subsequently forms the back of the printed product or (b) after the combining the cover and the booklet, imprinting or inscribing on the back of the printed product; and discharging the printed product from the spine processing device.

10. The method according to claim 1, wherein the applying adhesive includes coating an outermost signature of the booklet or an inside of the cover with adhesive in an adhesive application station.

11. The method according to claim 1, further comprising attaching the cover to the spine with the aid of a press-on roller;

pressing the cover in a spine area with the aid of at least one pressing device; and unfolding legs of the cover in an unfolding station.

12. The method according to claim 1, further comprising redirecting the printed product by approximately 180° in the spine processing device with aid of a reversing section.

13. The method according to claim 1, further comprising supplying successively a plurality of booklets of different compositions to the spine processing device; and processing the booklets into correspondingly different printed products in the spine processing device.

14. An apparatus for producing a printed product, the apparatus comprising:

a saddle stitcher configured to wire-stitch signatures to form a wire-stitched booklet comprising a plurality of the signatures and a spine, the saddle stitcher having a transport section; and a spine processing device coupled to the transport section via a diverter and comprising a reshaping device configured to reshape the spine of a diverted wire-stitched booklet, an adhesive application device, and a device to attach a cover to the booklet to form the printed product.

15. The apparatus according to claim 14, wherein the spine processing device comprises a separate module.

16. The apparatus according to claim 14, wherein the spine processing device forms a component of the saddle stitcher.

17. The apparatus according to claim 16, wherein the spine processing device is connectable and detachable from the saddle stitcher.

18. The apparatus according to claim 14, wherein the reshaping device, the adhesive application station, and the device to attach the cover are operable on the booklet while the booklet passes through the spine processing device.

19. The apparatus according to claim 14, wherein the spine processing device includes a section to change a direction of the booklet and to place the booklet into an upright position, wherein the section is arranged upstream of the reshaping device.

20. The apparatus according to claim 14, wherein downstream of the device to attach the cover, the spine processing device further includes a section to horizontally position the printed products.

21. The apparatus according to claim 14, wherein the spine processing device comprises a discharge region having a delivery station for the printed products, wherein the delivery station is coupled to the saddle stitcher.

22. The apparatus according to claim 14, wherein the saddle stitcher comprises a gathering section; and at least one stitching machine arranged after the gathering section in a transporting direction, wherein the spine processing device is arranged downstream of the stitching machine.

23. The apparatus according to claim 22, wherein the transport section is arranged downstream of the stitching machine, and wherein the spine processing device is connected to branch away from and empty into the transport section, wherein the spine processing device is one of connected to the transport section via the diverter to receive the booklet or circumvented by the transport section so that the booklet bypasses the spine processing device.

* * * * *